US007815274B2

(12) United States Patent
De Waal

(10) Patent No.: US 7,815,274 B2
(45) Date of Patent: Oct. 19, 2010

(54) METHOD FOR IDENTIFYING MISDIRECTING NOZZLES IN AN INKJET PRINTING APPARATUS

(75) Inventor: Cornelis A. De Waal, Broekhuizen (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 12/391,618

(22) Filed: Feb. 24, 2009

(65) Prior Publication Data

US 2009/0225115 A1 Sep. 10, 2009

(30) Foreign Application Priority Data

Feb. 25, 2008 (EP) ..... 08151867

(51) Int. Cl.
*B41J 29/38* (2006.01)
*B41J 29/393* (2006.01)

(52) U.S. Cl. ..... 347/12; 347/19

(58) Field of Classification Search ..... 347/12, 347/13

See application file for complete search history.

(56) References Cited

U.S. PATENT DOCUMENTS 5,581,284 A * 12/1996 Hermanson ..... 347/43
6,089,693 A 7/2000 Drake et al.
7,607,752 B2 * 10/2009 Childers et al. ..... 347/19

FOREIGN PATENT DOCUMENTS

EP 0988990 A2 3/2000

* cited by examiner

*Primary Examiner*—Matthew Luu
*Assistant Examiner*—Lisa M Solomon
(74) *Attorney, Agent, or Firm*—Birch, Stewart, Kolasch & Birch, LLP

(57) ABSTRACT

A method for detecting malfunctioning nozzles of an inkjet printer does not need any sensors, scanning means or processor time. The method includes printing a test pattern with an inkjet printer having at least one array of at least two nozzles, and for each array printing the test pattern includes selecting a nozzle of the array to be investigated, identifying for the nozzle a number of compensating nozzles, each compensating nozzle being suitable to replace the nozzle for printing a dot, and printing a row that includes at least two dot groups and each dot group includes at least one dot. At least one dot group is printed by the nozzle and at least one other dot group is printed by a nozzle of the number of compensating nozzles.

14 Claims, 6 Drawing Sheets

METHOD FOR IDENTIFYING MISDIRECTING NOZZLES IN AN INKJET PRINTING APPARATUS

CROSS-REFERENCE TO RELATED APPLICATIONS

This application claims priority under 35 U.S.C. §119(a) to Application No. 08151867.2, filed in Europe on Feb. 25, 2008, the entirety of which is expressly incorporated herein by reference.

BACKGROUND OF THE INVENTION

1. Field of the Invention

The present invention relates to a method for detecting malfunctioning nozzles of an inkjet printer having a print head, the print head comprising at least one array of at least two nozzles, each nozzle being configured to eject an ink drop which in operation is to result in a dot on the a recording medium. The present invention also pertains to an inkjet printing apparatus having a control unit and a print head, the print head comprising at least one array of at least two nozzles, wherein each nozzle is configured to eject an ink drop which in operation is to result in a dot on a receiving medium, the control unit being configured to control the inkjet printing apparatus.

2. Description of Background Art

Inkjet printers have at least one inkjet print head from which ink is ejected on a receiving medium. An inkjet print head comprises at least one array of nozzles from which amounts of ink are ejected for forming an image on the receiving medium.

A method is known from U.S. Pat. No. 6,089,693 for printing an image by a print head including one or more non-functioning nozzles and a plurality of functioning nozzles. Non-functioning nozzles are identified by a defective nozzle detector being incorporated as part of the print head. It is disclosed that, in addition, a test pattern could be printed identifying to a user which of the nozzles are non-functioning and therefore non-productive. The test pattern includes nozzle identifiers, such as a number, which is printed by each of the functioning nozzles and which identifies a nozzle. The missing number would indicate to the user which of the nozzles is non-functioning.

Another category of non-productive nozzles are misdirecting nozzles. By misdirection of an ink drop ejected from the nozzle towards the receiving medium, the ink drop is not delivered on a spot on the receiving medium, which was intended by the ink jet control unit. EP 0 988 990 describes a method to detect misdirecting nozzles, wherein a test pattern is printed on a recording medium. The test pattern is scanned by sensor means to capture an image of ink drops on the recording medium. The image is processed to determine an average position of the ink drops. The actual positions of the ink drops are compared with the average position to detect deviations due to misdirecting nozzles.

For detecting deviations on the test image sensor means for scanning the image and processor time for calculating average positions are required, since the diameter of the nozzles, which constitute the printing head become small resulting in small ink drops on the receiving medium. Artifacts due to deviations are hardly visible for the human eye.

SUMMARY OF THE INVENTION

An object of the present invention is to provide a method for detecting malfunctioning nozzles of an inkjet printer, which does not need any sensors, scanning means or processor time.

The object is achieved in a method for visually detecting misdirecting nozzles of an inkjet printer, the method being suitable for detecting nozzles misdirecting in a first direction, the method comprising printing a test pattern and for each array printing the test pattern comprises the steps of selecting a nozzle of said array to be investigated, identifying for said nozzle a number of compensating nozzles, each compensating nozzle being suited to replace the said nozzle for printing a dot, printing a row, the row extending in a second direction being different from the first direction and comprising at least two dot groups and each dot group comprising at least one dot, wherein at least one dot group is printed by said nozzle and at least one other dot group is printed by a compensating nozzle selected from the said number of compensating nozzles and the method further comprising visually comparing a position of a dot group printed in the row by said selected nozzle with a position of a dot group printed in the row by the compensating nozzle.

According to the present invention, the test pattern is designed in such a way that malfunctioning nozzles are easily detectable on the test pattern without using sensor means and processor time, but using the human visual system. This easy detection is achieved, since in each printed row on the test pattern, a deviation in dot groups is visible by inspection by the human eye in the case that the nozzle under investigation is malfunctioning. When the nozzle under investigation is well functioning, the printed row of the test pattern is a substantially continuous row of dot groups printed by the nozzle under investigation and the compensating nozzle. All these correctly positioned dot groups form a predetermined shape, such as a (semi-)continuous line, or the like. In the case that the nozzle under investigation is malfunctioning, dot groups in the printed row on the test pattern, that are printed by compensating nozzles, deviate in position from an intended position in the printed row. The printed row of dot groups shows dot groups that substantially deviate from the predetermined shape, e.g. a line formed by this continuous row in height or width. In order to easily detect a deviation of a dot group in the row using the human visual system, a dot group to be printed by the compensating nozzle may be adjacent to a dot group to be printed by the nozzle under investigation.

A compensating nozzle is another nozzle than the nozzle under investigation and is suitable to print a dot on the same position as a position on which the nozzle under investigation is intended to print a dot. A compensating nozzle may be identified in a number of ways. A compensating nozzle may be positioned on the print head in the neighborhood of the nozzle under investigation. A neighboring nozzle in the same array as the nozzle under investigation may be a candidate for compensating. If the print head contains more than one array, a nozzle in a neighboring array of the array of the nozzle under investigation may also be a candidate for compensating. A compensating nozzle is selected from the number of candidates (the number may be one or may be more). The compensating nozzle is able to replace the nozzle under investigation in order to print one or more dot groups in the same row of dot groups printed by the nozzle under investigation.

Each nozzle under investigation may print dot groups in exactly one row. Consequently the number of printed rows on the test pattern corresponds to the number of nozzles under investigation. It is easily detectable from each row on the test pattern whether or not a corresponding nozzle under investigation is malfunctioning. Since each row corresponds to a single nozzle to be investigated, inspection of a single row immediately identifies a possibly misdirecting or otherwise malfunctioning nozzle.

In an embodiment, the nozzle under investigation is—in the method according to the invention—compensated for by a one single compensating nozzle. If compensating in a row is achieved by one single compensating nozzle, each dot group in that row which is compensated for has a same deviation from an intended position, resulting in a more surveyable test pattern and more accurate drawing of conclusions. In particular, a correct conclusion may be drawn when a compensating nozzle itself is malfunctioning, because in the case of more than one compensating nozzle in a row, it becomes difficult to distinguish the malfunctioning nozzles from the well functioning nozzles. Moreover, it may be convenient to let a compensating nozzle only compensate for one nozzle under investigation. In other words, a compensating nozzle may be engaged in only one printed row. Using a unique collection of compensating nozzles for each row of printed dot groups is advantageous in case that a compensating nozzle itself is malfunctioning. The advantage is that the possibility that wrong conclusions are drawn concerning malfunctioning of the first nozzles is reduced towards drawing wrong conclusions for one printed row.

In an embodiment, the print head may comprise a first array and a second array, and for each printed row the first array comprises the first nozzle and for each printed row the second array may provide a compensating nozzle.

The second array may be selected to be an array near the first array or any other array. It may be selected in such a way that a row of dot groups is printed during a first scan of the print head from left to right and a second scan of the print head from right to left. A paper step may by performed between the first and second scan. For example, the dot groups printed during the first scan may be printed by the nozzle under investigation and the dot groups printed during the second scan may be printed by the compensating nozzle or the other way around. This has the advantage that the test pattern is produced in a time-efficient way.

In an embodiment, a two-dimensional array of dot groups may be printed, consisting of rows and columns of printed dot groups. The dot groups in each printed row may be numbered from 1 to N from the left to the right hand side of the test pattern. All n-th printed dot groups in the printed rows may form an n-th column of the matrix of dot groups. The two-dimensional array of dot groups may be constructed in such a way that each column of the array comprises one single dot group that is printed by a compensating nozzle.

This way of printing dot groups is advantageous, since a deviation in a column of dot groups immediately identifies a printed row, in which the nozzle under investigation is malfunctioning. The nozzle under investigation of the printed row that comprises the deviating dot group printed by the compensating nozzle is a nozzle that is malfunctioning.

In an embodiment, a two-dimensional array of dot groups may be constructed in such a way that a row of dot groups is printed by a nozzle under investigation, except for exactly one dot group in that row that is printed by a compensating nozzle. An advantage of compensating accordingly is that a deviation is easily detected by looking only at one position in the row, namely the position of the dot group printed by the compensating nozzle.

By combining the features of the above two embodiments, each row and each column of the two-dimensional array may contain precisely one deviating dot group. In each printed row one single dot group is printed by a compensating nozzle and in each column of the two-dimensional array of dot groups, one single dot group is printed by a compensating nozzle. Further, the number of printed rows of dot groups is equal to the number of nozzles under investigation and the number of printed columns of dot groups is also equal to the number of nozzles under investigation.

A special embodiment of such a two-dimensional array of dot groups may be that the nozzles to be investigated are numbered from 1 to N, the dot groups in a printed row may be numbered from 1 to N and the printed rows may be numbered from 1 to N (N is the number of nozzles to be investigated). Compensating may be applied in such a way that an i-th printed row of dot groups is printed by an i-th nozzle of the nozzles under investigation except an i-th dot group in the i-th printed row of dot groups. The i-th dot group in the i-th print row of dot groups may be printed by a compensating nozzle. This has the advantage that, since columns and rows of dot groups on the test pattern are numbered from 1 to N, a deviating dot group in an i-th column immediately identifies the malfunctioning nozzle, namely the i-th nozzle of the nozzles under investigation. Numbering of the nozzles under investigation may be according to the position of these nozzles on the array of the print head, for example.

A result of this construction of the two-dimensional array is that dot groups printed by compensating nozzles are lying on a diagonal of the two-dimensional array and are therefore easily identifiable.

In an embodiment, each printed dot group on the test pattern may have a height of a predetermined number of dots and a width of a predetermined number of dots. The height and width of a dot group may be selected in such a way that the dot group is large enough to be seen by the human eye and can easily be distinguished from a neighboring dot group. Moreover, a deviation in a row of dot groups or a column of dot groups on the test pattern caused by a malfunctioning nozzle may be easily seen by the human eye. Moreover, to see the deviation easily, a dot group to be printed by a compensating nozzle may be positioned on the test pattern adjacent to a dot group to be printed by a nozzle under investigation.

Above-mentioned embodiments may be used for printing a test pattern for detecting malfunctioning nozzles. Malfunctioning nozzles may be non-functioning nozzles that do not drop ink at all or may be misdirecting nozzles that drop ink on other places as expected.

In the case of a non-functioning nozzle, the nozzle does not drop any ink on the test pattern and an empty position in the row of dot groups on the test pattern may appear. Such an empty position may be easily detected on the test pattern and the non-functioning nozzle may be detected at once.

In the case of a misdirecting nozzle, the misdirection of the dot ejected by the nozzle may be in an arbitrary direction. A direction may be a direction parallel to the direction of the paper feed step of the inkjet printer. A deviation in the direction parallel to the paper steps may show up in a printed row, in which a position of a dot group printed by the misdirecting nozzle and a position of a dot group printed by a compensating nozzle may differ in the direction perpendicular to the direction of the printed row. In this way, a misdirecting nozzle is detected on the test pattern if it is misdirecting in the direction parallel to the paper feed step.

To distinguish a deviating dot group in the direction parallel to the direction of the paper feed step more explicitly, the width of a dot group (parallel to the paper feed step) may be selected to be relatively larger such that any deviation from the predetermined shape to be formed by the dot groups is readily identifiable.

Furthermore, a deviation in a direction perpendicular to the direction of the paper feed step may also be detected. A deviation in the direction perpendicular to the direction of the paper feed step may show up as a gap in a printed row between a dot group printed by a misdirecting nozzle and a dot group printed by a compensating nozzle. By searching for this kind of gap, a misdirecting nozzle may be detected on the test pattern if they misdirect in the direction perpendicular to the direction of the paper feed step. As a matter of fact, this direction may be less important, since a deviation caused by misdirecting in the direction of the longitudinal movement of the print head may be less visible as an artifact on the receiving medium when printing an image.

To distinguish a deviating dot group in the direction perpendicular to the direction of the paper feed step more explicitly, the height of a dot group (perpendicular to the paper feed step) may be selected relatively larger such that any deviation from the predetermined shape to be formed by the dot groups is readily identifiable.

A test pattern may comprise dots of a number of ink colors depending on the number of ink colors to be used in the inkjet printing apparatus. A compensating nozzle may eject the same ink color as the nozzle under investigation. In case of a yellow ink ejecting nozzle, a part of the test pattern concerning testing the yellow ink ejecting nozzle may be printed with an additional other color to generate a printed row having a color that increases the visibility. For example, if magenta is selected to be the additional color, a printed row with red colored dot groups may be generated to increase the visibility of yellow by printing the dot groups using both yellow and magenta ink. A non-functioning yellow ink ejecting nozzle may result in a dot group not only deviating in position but also in color. A non-functioning magenta ink ejecting nozzle may appear in a row of magenta dot groups as a white row of missing dot groups and in a row of red dot groups as a yellow row of dot groups. It may be evident to one having ordinary skill in the art that by selecting a color for the compensating nozzle other than a color of the ink ejected by the nozzle under investigation, malfunctioning nozzles may be identified as well.

It is obvious for one having ordinary skill in the art that the working up of the test pattern may be carried out by visual inspection, but may as well be automated by means of an image processing software program to be loaded in the control unit of a printer or scanner.

The present invention also pertains to a computer readable medium that comprises computer executable instructions for instructing a computer processing device to control a printing apparatus to perform an embodiment of the present invention.

The present invention also pertains to an inkjet printing apparatus comprising a control unit and a print head. The print head may comprise at least one array of at least two nozzles, wherein each nozzle is configured to eject an ink drop resulting in a dot on a receiving medium. The control unit is configured to control the inkjet printing apparatus to perform the method according to the present invention. In such an inkjet printing apparatus, it is possible to select a compensating nozzle different from the nozzle under investigation and thus to be compensated for.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
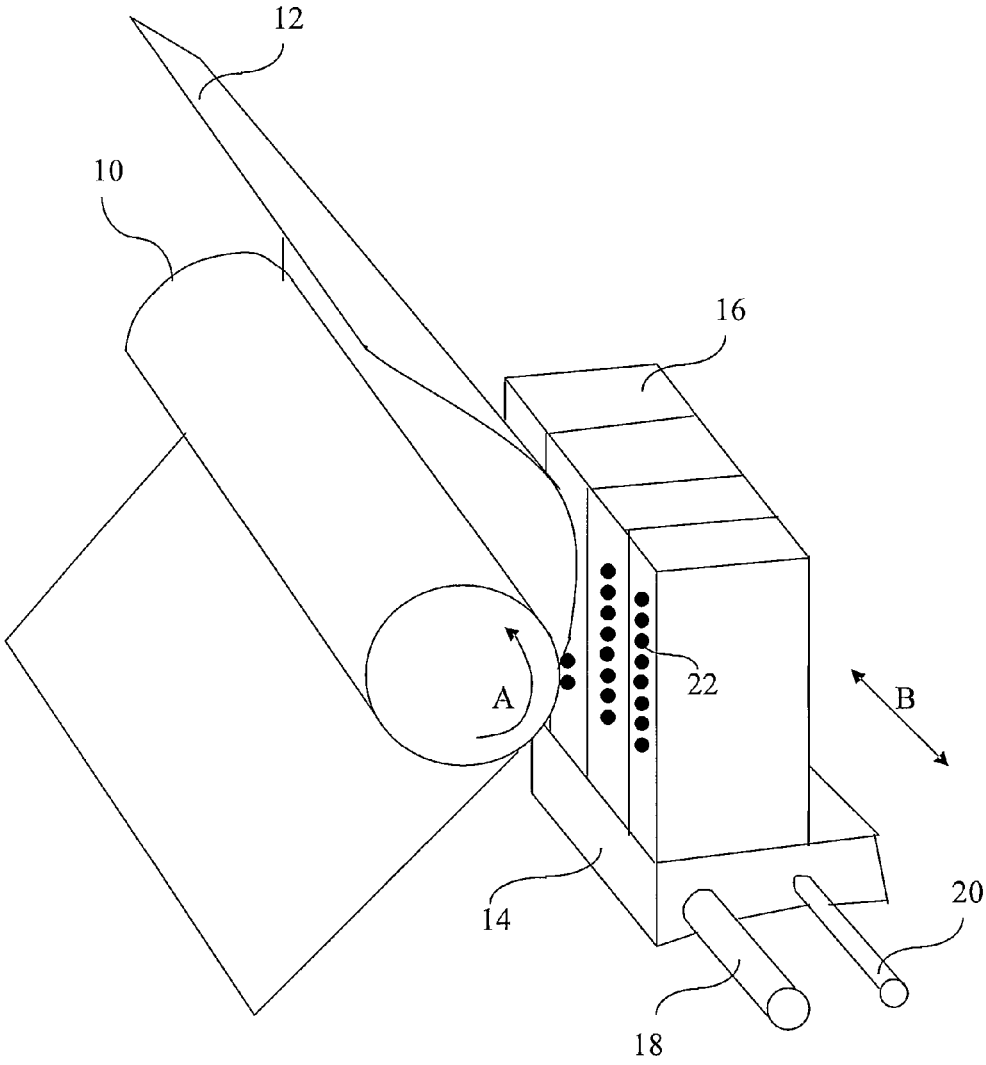
FIG. 1 is a diagram of the main components of an inkjet printing apparatus.

The present invention will now be described with reference to the accompanying drawings, wherein the same reference numerals have been used to identify the same or similar elements throughout the several views.

FIG. 1 shows an inkjet printer provided with a number of print heads comprising nozzles. In this embodiment, the inkjet printer comprises a roller 10 to support a receiving medium 12 and guide it along four printing heads 16. The roller 10 is rotatable about its axis as indicated by the arrow A. A carriage 14 carries the four print heads 16, one for each of the colors cyan, magenta, yellow and black, and can be moved in reciprocation in the direction indicated by the double arrow B, parallel to the roller 10. In this way, the print heads 16 can scan the receiving medium 12. The carriage 14 is guided on rods 18 and 20 and is driven by suitable means (not shown). In the embodiment as illustrated in FIG. 1, each print head 16 comprises eight nozzles 22, which form an imaginary line perpendicular to the axis of the roller 10. In a practical embodiment of an inkjet printer, the number of nozzles per print head 16 may be many times greater and may be arranged in one or more arrays per print head. In an embodiment, each nozzle is in fluid connection with a respective pressure chamber, which is provided with an actuator such as a piezoelectric element (not shown) and associated drive circuit. In this way, the pressure chamber, the actuator and the drive circuit form a unit that can serve to eject ink drops from the respective nozzle in the direction of the roller 10. If the respective actuators are activated image-wise, an image built up of ink drops forms on the receiving medium 12, which image may be according to a test pattern.

The ejection of an ink drop on the medium may be on the intended spot position. However, due to for example pollution of the nozzle or mechanical defects in the pressure chamber or in the nozzle aperture, the ink drop may be misdirected or even no ink drop may leave the nozzle aperture. To investigate if a nozzle is non-functioning or malfunctioning (for example misdirecting), a test pattern can be printed on the receiving medium. The test pattern may consist of printed rows of dot groups. Each dot group consists of a group of ink drops and is visible to the human eye. In each printed row of dot groups, one or more dot groups may be printed by a nozzle under investigation and one or more dot groups may be printed by another nozzle, which is able to print a dot group on the same places as the nozzle under investigation can print, the so-called compensating nozzle. A dot group printed by such a compensating nozzle will be printed in the row in such a way that its position will deviate from the positions of the dot groups printed by the nozzle under investigation, if the compensating nozzle is misdirecting or the nozzle under investigation is misdirecting. It is noted that a row of dot groups as used in the present invention, may form any kind of shape. Hereinafter, it is assumed that the rows are arranged such that they form a straight line. However, other shapes are envisaged as well. For example, a circularly shaped row may be used in order to increase the visibility of a position deviation in both the scanning direction of the print head and a paper-feed direction.

Figure 2A:
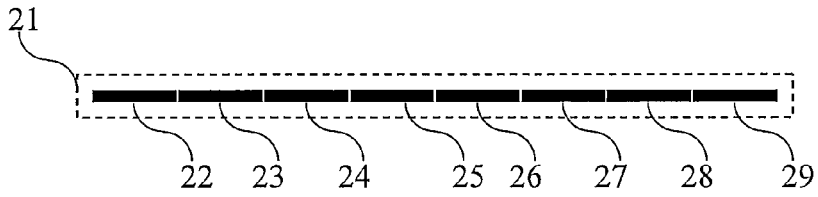
FIGS. 2*a*-2*b* show a printed row on a test pattern.

FIG. 2*a* shows a part of a test pattern, which part contains a printed row 21. The printed row 21 may comprise a number of dot groups, for example eight dot groups 22-29. The dot groups 22-29 in the printed row 21 may have been printed in such a way that the dot groups 22-29 are concatenated and form a continuous line with thickness being substantially equal to a height of the dot groups 22-29. The dot groups 22-29 may have been printed by a nozzle under investigation from a print head and by one or more compensating nozzles. Since the dot groups 22-29 of the printed row form a continuous line, one of two following conclusions may be correct. A first conclusion may be that the first nozzle and the one or more compensating nozzles are functioning correctly. A second conclusion may be that both the first nozzle and the one or more compensating nozzles are all malfunctioning in the same way. This example shows that to draw the right conclusion of the two conclusions mentioned above a test pattern may contain more than one printed row, moreover it may be convenient to have a printed row for each nozzle that is selected to be investigated. It is remarked that in this case more information about the construction of the test pattern is necessary to determine which dot groups of the first printed row 21 are printed by the one or more compensating nozzles and which dot groups of the first printed row 21 are printed by the nozzle under investigation.

Figure 2B:
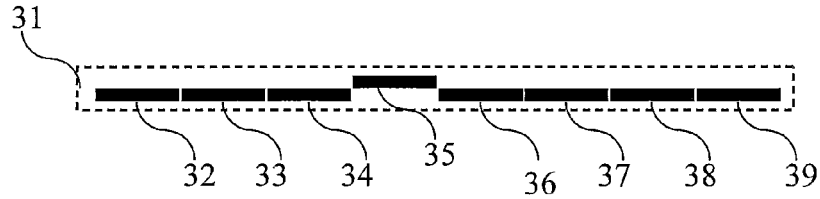

FIG. 2*b* shows a part of a test pattern, which part contains a printed row 31. The printed row 31 may comprise a number of dot groups, for example eight dot groups 32-39. The dot groups 32-39 are strongly concatenated, except the dot groups referenced with numerals 34, 35 and the dot groups reference by numerals 35 and 36. Moreover, the dot groups 32-39 do not form a continuous line. The dot groups, referenced by numerals 32-34 and numerals 36-39, may have been printed by a nozzle under investigation from a print head and the dot group referenced with numeral 35 may have been printed by a compensating nozzle. Since the dot groups 32-39 of the printed row do not form a continuous line, a conclusion may be drawn that the nozzle under investigation or the compensating nozzle is malfunctioning. Since the position of the dot group 35 is deviating in its position in a direction parallel to the media advance direction, the nozzle under investigation or the compensating nozzle is misdirecting in the advance direction of the paper.

Based on the row 31 of dot groups 32-39 the user of the test pattern is not able to detect whether the nozzle under investigation is misdirecting or a compensating nozzle is misdirecting. Which one of the two possibilities is occurring, may be immediately clear when a test pattern with a row of dot groups for each nozzle is printed.

Figure 2C:
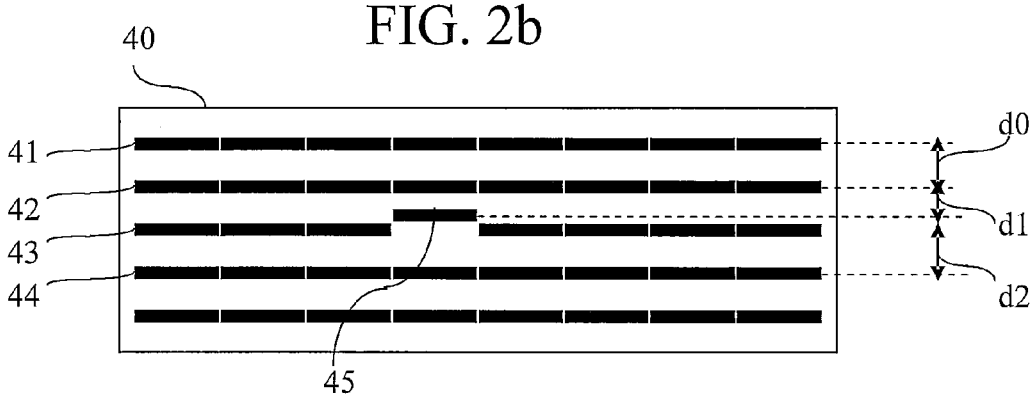
FIG. 2*c* shows a test pattern, which contains a number of printed rows and one of the printed rows shows a deviation caused by a misdirecting nozzle under investigation.

In FIG. 2*c*, an example of such a test pattern 40 is shown. The test pattern contains five printed rows of dot groups. By looking at distances between the five printed rows it is easy to detect whether in a printed row a corresponding nozzle under investigation or a compensating nozzle is misdirecting. In FIG. 2*c* a distance between a first printed row 41 and a second printed row 42 is indicated by a first arrow d0. Since a dot group 45 printed by a compensating nozzle is deviating from a line formed by printed row 43, a distance between the printed row 42 and the deviating dot group 45 is not equal to a distance indicated by the first arrow d0, but equal to a distance indicated by a second arrow d1. A distance between the printed row 44 and the deviating dot group 45 is not equal to a distance indicated by the first arrow d0 either, but is equal to a distance indicated by a third arrow d2, and the distances indicated by the second arrow d1 and the third arrow d2 are not equal to each other. In the case of FIG. 2*c* the compensating nozzle is misdirecting.

Figure 2D:
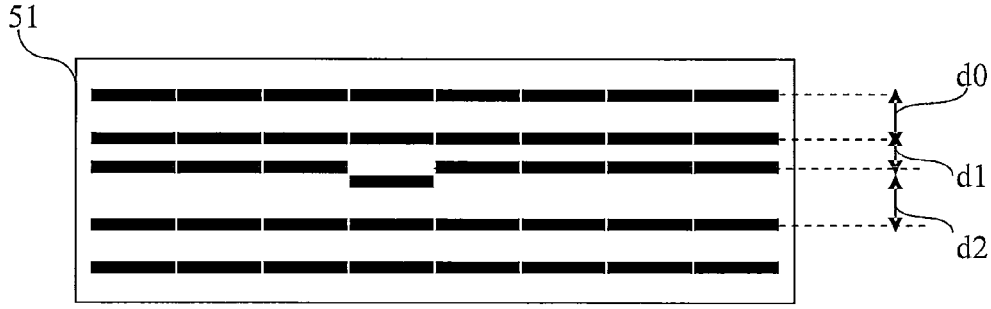
FIG. 2*d* shows a test pattern like FIG. 2*c*, which contains a deviating printed row, caused by a misdirecting compensating nozzle.

Similar to the above reasoning, it may be concluded that in FIG. 2*d* the first nozzle is misdirecting.

Figure 2E:
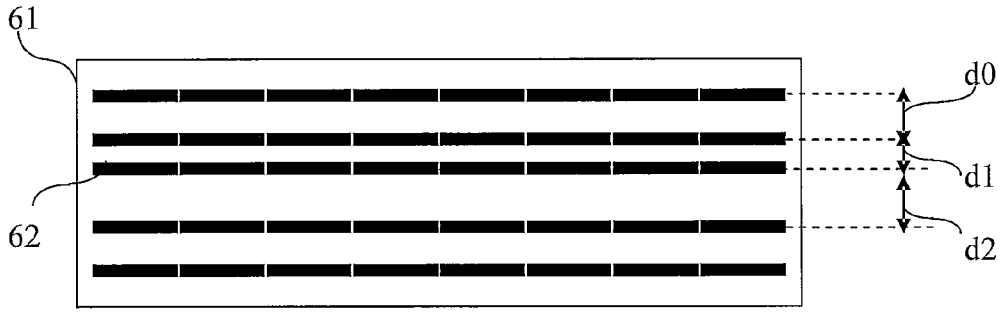
FIG. 2*e* shows a test pattern like FIG. 2*d*, in which deviations are visible due to a misdirecting nozzle under investigation and a misdirecting compensating nozzle.

In an exceptional situation, a first nozzle and a compensating nozzle having printed dot groups in the same row are both misdirecting. Such a situation is shown in FIG. 2*e*. In FIG. 2*e* a particular printed row 62 on a test pattern 61 is a continuous line in which there may be a first distance, indicated by a first arrow d1, between the particular printed row 62 and a printed row directly above the particular printed row 62 and there may be a second distance, indicated by an second arrow d2, between the particular printed row 62 and a printed row directly beneath the particular printed row 62. These two distances, indicated by arrows d1, d2 are not the same and therefore it is concluded that both the nozzle under investigation and the compensating nozzle are misdirecting. In this particular case, the nozzle under investigation and the compensating nozzle have a deviation in the same direction. An extra check if the right conclusion is drawn, in this particular case, may be implemented by also selecting the compensating nozzle of the particular printed row 62 in the selection of nozzles to be investigated. A row of dot groups, printed by a nozzle under investigation that is the compensating nozzle of the particular printed row 62, will then also show deviations.

Figure 2F:
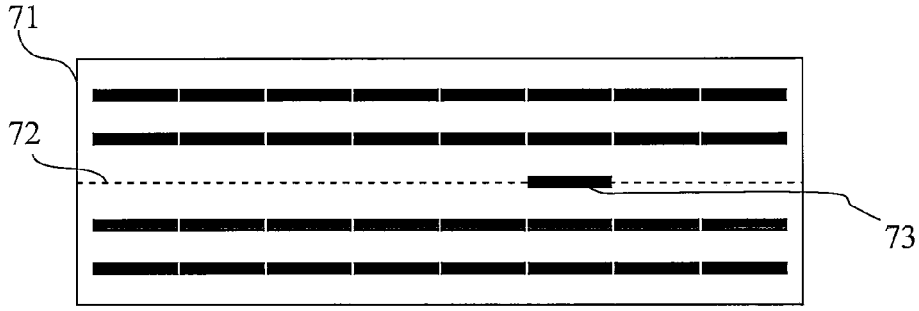
FIG. 2*f* shows a test pattern on which deviations are visible due to a non-functioning nozzle.

In FIG. 2*f*, another test pattern 71 is shown. In this case, a nozzle under investigation of a printed row 72 is non-functioning and does not eject any ink on the test pattern. The printed row 72 consists only of a dot group 73 printed by a compensating nozzle. The possibilities described above for misdirecting nozzles may also occur for non-functioning nozzles and may be handled in the same way. The only difference is that no deviating dot group is established, but in a printed row one or more empty places are established, on which a dot group should have been printed.

Figure 3A:
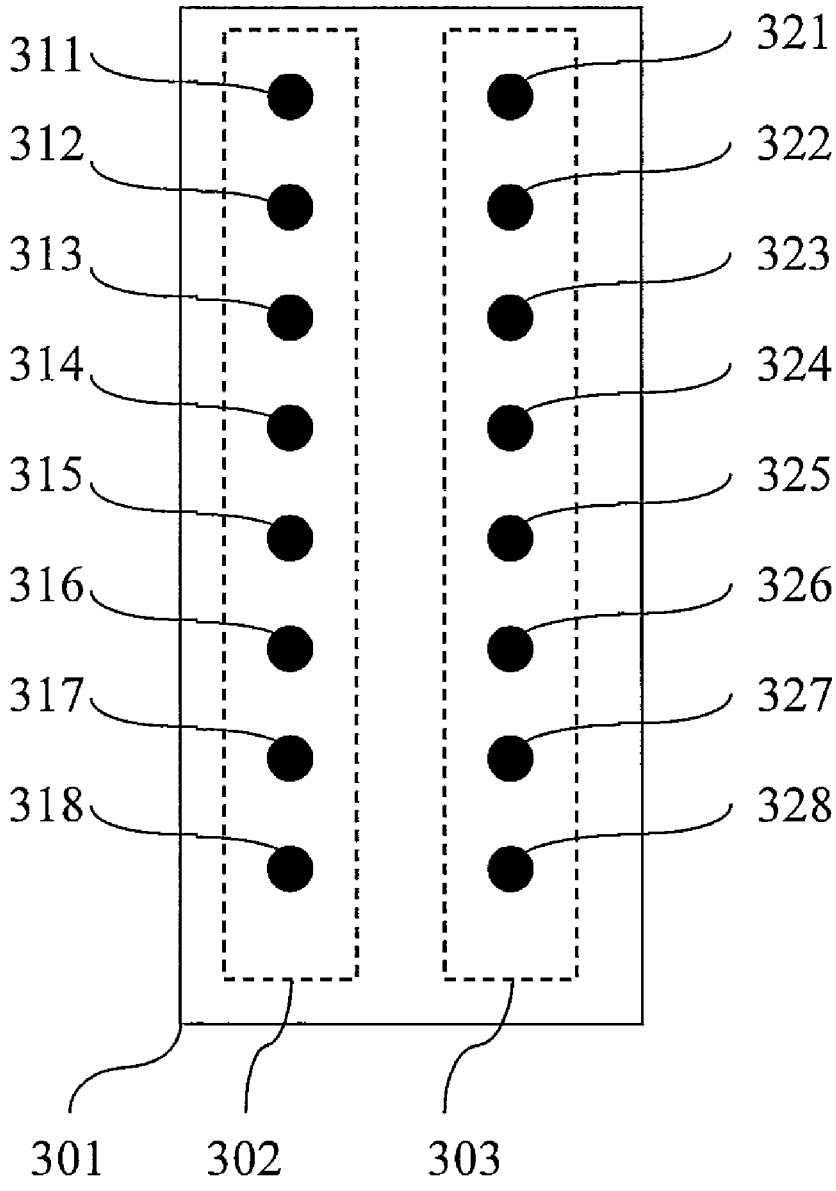
FIG. 3*a* shows a print head with two arrays of nozzles.

FIG. 3*a* shows a print head 301 with two arrays of nozzles. A first array 302 has eight nozzles 311-318 and a second array 303 has eight nozzles 321-328. To test a nozzle 311, a compensating nozzle has to be found in the neighborhood of the nozzle 311, which is able to eject an ink drop on the same places on which the nozzle 311 under investigation will eject ink drops. A candidate for a nozzle which will compensate the nozzle 311 under investigation may be first nozzle 321 in the second array 303. Consequently, the nozzles 311-318 of the first array 302 may be tested by producing a test pattern in such a way that the nozzles 321-328 of the second array 303 are compensating nozzles for the nozzles 311-318 of the first array 302. A first nozzle 311 of the first array 302 may be compensated by a first nozzle 321 of the second array 303, a second nozzle 312 of the first array 302 may be compensated by a second nozzle 322 of the second array 303 and so further.

It is remarked that by suitably selecting a compensating nozzle, the compensating nozzle is the closest nozzle of the second array 303 to a nozzle under investigation of the first array 302. By selecting the compensating nozzles 321-328 in such a way, a printed row of dot groups on a test pattern may be printed in one single forward traverse of the print head 301 or in a forward traverse and a backward traverse of the print head 301. In the latter case, dot groups to be printed by the first nozzles 311-318 may be printed in the forward traverse, and dot groups to be printed by the compensating nozzles 321-328 may be printed in the backward traverse or the other way around. When the nozzle under investigation and the compensating nozzle are not positioned on the same height in the print head, a paper step may be carried out between the forward traverse and the backward traverse.

Figure 3B:
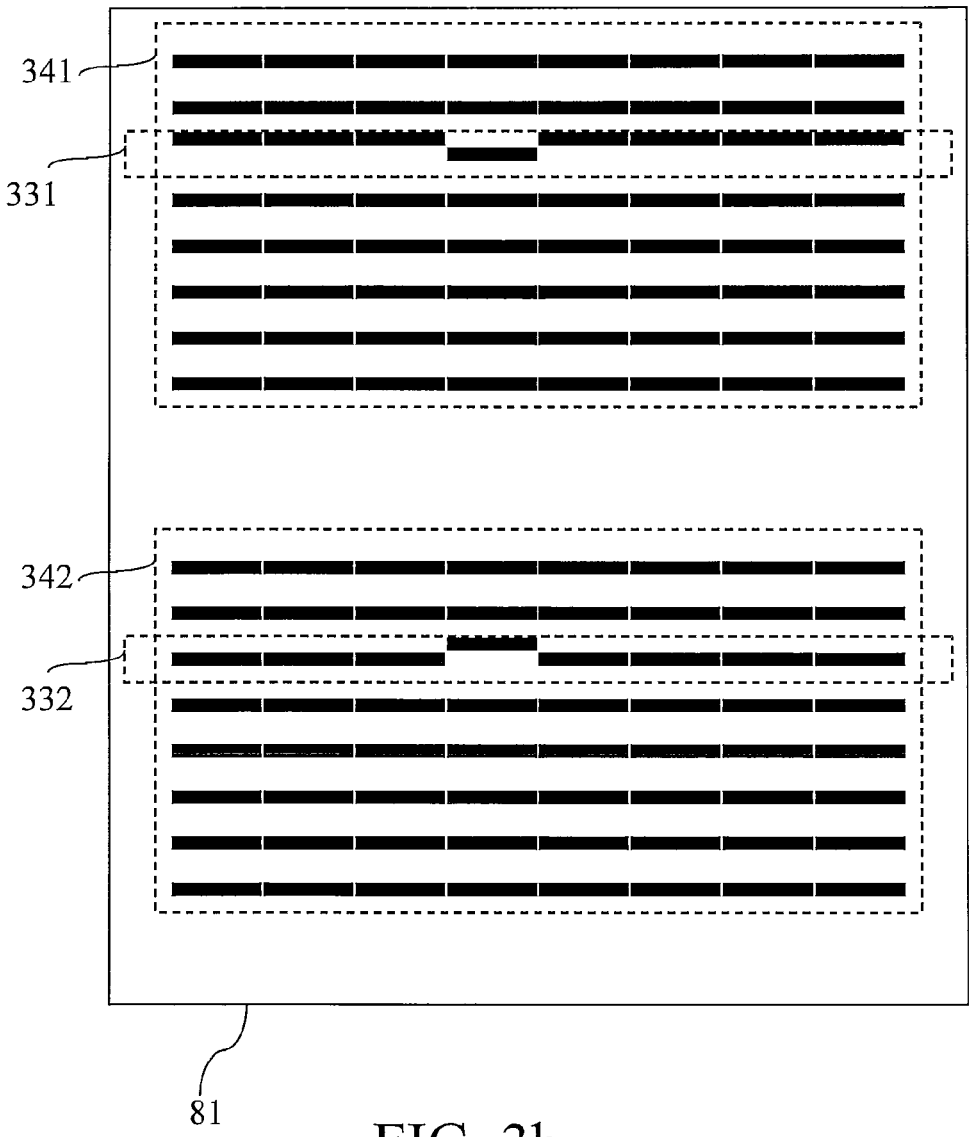
FIG. 3*b* shows a test pattern belonging to a test for the nozzles of the print head of FIG. 3*a;*

FIG. 3*b* shows a test pattern 81 belonging to a test for the print head 301 shown in FIG. 3*a*, the print head 301 containing nozzles 311-318 of a first array 302 and nozzles 321-328 of a second array 303. In a first block 341 of eight printed rows the nozzles 311-318 of the first array 302 may be tested and compensated by the nozzles 321-328 of the second array 303 as described in the description of FIG. 3*a*. In a second block 342 of eight printed rows, the nozzles 321-328 of the second array 303 may be tested and compensated by the nozzles 311-318 of the first array 302. Deviations are visible in two printed rows 331, 332. In a first deviating row 331, a nozzle 313 under investigation belonging to this printed row 331 is misdirecting, while a compensating nozzle 323 belonging to this printed row 331 is well functioning. In a second deviating row 332, a nozzle 323 under investigation belonging to this printed row 332 is well functioning, while a compensating nozzle 313 belonging to this printed row 332 is misdirecting. A conclusion that a particular nozzle is misdirecting may be based on deviations in a printed row of dot groups, the nozzle under investigation of the printed row being the particular nozzle, and may be supported by looking for deviations in a printed row, of which a compensating nozzle is the particular nozzle. On the other hand a conclusion that a particular nozzle is misdirecting may be based on deviations in a printed row of dot groups, of which printed row a compensating nozzle is the particular nozzle, and may be supported by looking for deviations in a printed row, the nozzle under investigation of the printed row being the particular nozzle.

Figure 4:
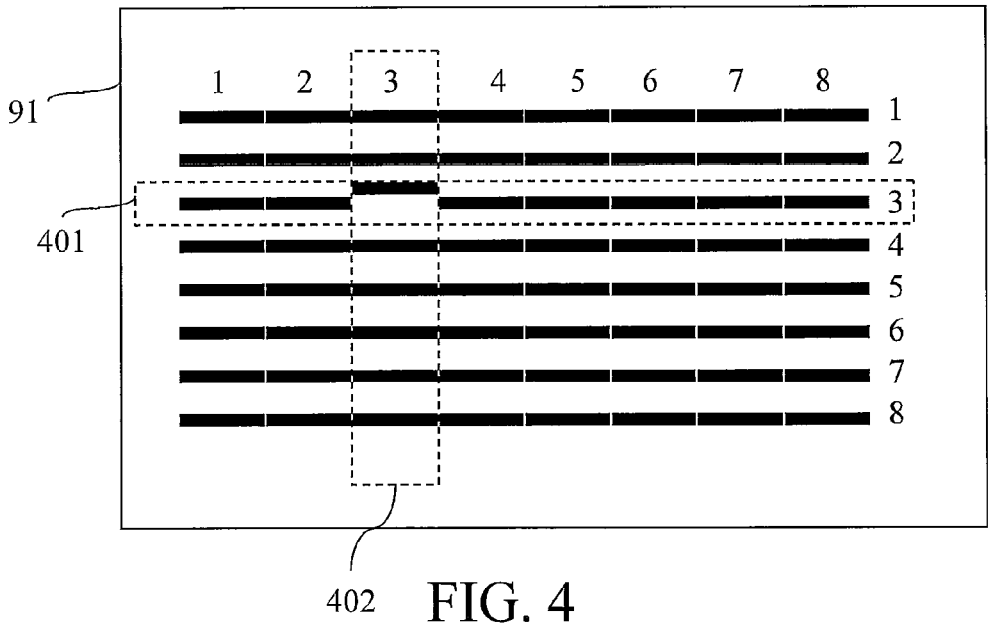
FIG. 4 shows a test pattern on which the printed rows and printed columns are numbered.

In FIG. 4, a test pattern 91 is shown in which a matrix of dot groups is constructed, in which each dot group is an intersection of a printed row and a printed column. Each printed row and each printed column is numbered from one to eight. Now a special way of compensating is described. Compensating may be implemented such that an i-th printed row (numbered i) may be printed by an i-th nozzle of eight nozzles to be investigated except for an i-th dot group in the i-th printed row. An i-th dot group in the i-th printed row may be printed by a compensating nozzle. In FIG. 4, a deviation shows up in a third printed column 402. Because of the implementation of compensating as described above, it may immediately be concluded that a third nozzle of the eight to be investigated nozzles is misdirecting. This is also visible when looking at a third printed row 401. One having ordinary skill in the art will understand that an embodiment with eight nozzles has been chosen for illustrative purposes only in the above example. Ink jet printers normally have a much larger amount of nozzles per array per print head. A test pattern for many nozzles may have larger dimensions and is possibly to be produced according to the principles above by an inkjet printing apparatus, which may handle large formats like A0, A1, etc. Dimensions of a dot group may be selected such that the test pattern fits on the available recording medium. It may be sufficient to only number rows or columns. The decision to number either rows or columns may depend on the available space on the test pattern needed to print readable non-overlapping row numbers or column numbers, for example. Numbering may be omitted completely, although numbering is useful for a quick and less error sensitive analysis, especially in the case of a large number of dot groups in a printed row or a large number of dot groups in a printed column, for example when testing a inkjet printing apparatus comprising 16 or more nozzles per array. As apparent to those skilled in the art, numbering as shown in FIG. 4 may also be applied to test pattern 81 in FIG. 3*b*.

Figure 5:
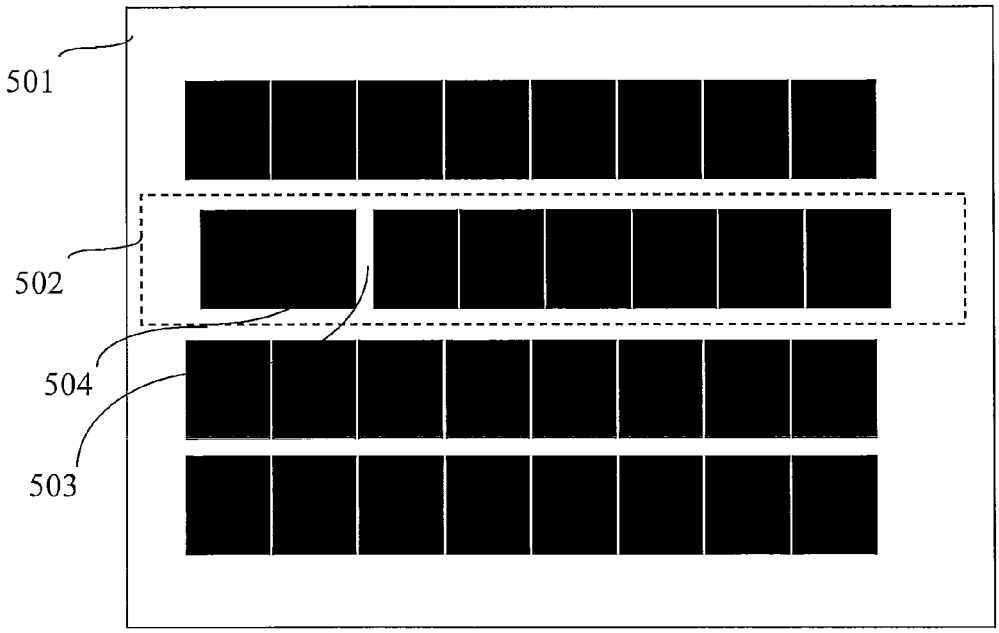
FIG. 5 shows a test pattern on which dot groups have a larger height than width.

FIG. 5 shows an example of a test pattern 501 in which dot groups have a larger height than the height of a dot group on hereinabove described test patterns. Dot groups with a larger height may be beneficial when investigating when nozzles are misdirecting in a direction perpendicular to the direction of the paper steps. By printing dot groups with a large height, deviations of this kind may be detected. The test pattern shows a deviating printed row 502 of dot groups including a gap 503. A particular dot group 504 of the deviating printed row 502 is shifted slightly to the left of the test pattern 501 relatively to all other dot groups in the deviating printed row 502. As a matter of fact, the dot groups of the deviating printed row 502, except the particular dot group 504, are slightly shifted to the right of the test pattern 501. This fact may also be observed by looking at the positions of the beginnings and the endings of all printed rows. It may be concluded that the nozzle under investigation which printed the deviating printed row 502, is misdirecting in the direction perpendicular to the direction of the paper step, while the particular dot group 504 is printed by a compensating nozzle, which is not misdirecting.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for visually detecting misdirecting nozzles of an inkjet printer, the method being suitable for detecting nozzles misdirecting in a first direction, the inkjet printer comprising a print head, the print head comprising at least one array of at least two nozzles, each nozzle being configured to eject an ink drop for generating a dot on a recording medium, the method comprising printing a test pattern, and for each of the at least one array, printing the test pattern comprises the steps of:

selecting a nozzle of said at least one array to be investigated;

identifying for said selected nozzle a number of compensating nozzles, each compensating nozzle being suitable to replace said selected nozzle for printing a dot;

printing a row, the row extending in a second direction being different from the first direction and comprising at least two dot groups, each dot group comprising at least one dot, wherein at least one dot group is printed by said selected nozzle and at least one other dot group is printed by a compensating nozzle selected from said number of compensating nozzles identified in said step of identifying;

visually comparing a position of a dot group in the row printed by said selected nozzle with a position of a dot group in the row printed by said compensating nozzle selected in said step of printing; and investigating a plurality of the at least two nozzles of said array by repeating said steps of selecting, identifying and printing, wherein the dot groups printed by the compensating nozzles are lying on a diagonal of a two-dimensional array of dot groups.

2. The method according to claim 1, further comprising the step of printing each at least one dot group printed by the compensating nozzle by a same compensating nozzle.

3. The method according to claim 1, wherein the print head comprises a first array and a second array and the first array comprises the selected nozzle and the second array comprises the compensating nozzle of the number of compensating nozzles selected in said step of printing.

4. The method according to claim 1, further comprising the step of selecting a number of dots of each dot group such that the dot group is visible to the human eye.

5. The method according to claim 1, wherein a compensating nozzle selected to compensate a selected nozzle is different from any compensating nozzle selected to compensate another selected nozzle.

6. The method according to claim 1, further comprising the steps of:

printing a number of rows of N dot groups, N being a natural number greater than one; and arranging the number of rows to form N columns of dot groups, each column of dot groups comprising only one dot group printed by a compensating nozzle.

7. The method according to claim 1, wherein each printed row of dot groups comprises only one dot group printed by a compensating nozzle.

8. The method according to claim 1, wherein the two-dimensional array of dot groups are formed by the dot groups arranged in the rows and the columns.

9. The method according to claim 1, wherein the test pattern is used to detect non-functioning nozzles.

10. The method according to claim 1, wherein the compensating nozzle selected in said step of printing is configured to eject ink of a color different from a color of ink being ejectable by the nozzle selected in said step of selecting.

11. A non-transitory computer readable medium, comprising computer executable instructions for instructing a computer processing device to control a printing apparatus to perform a method for visually detecting misdirecting nozzles of an inkjet printer, the method being suitable for detecting nozzles misdirecting in a first direction, the inkjet printer comprising a print head, the print head comprising at least one array of at least two nozzles, each nozzle being configured to eject an ink drop for generating a dot on a recording medium, the method comprising printing a test pattern, and for each of the at least one array, printing the test pattern comprises the steps of:

selecting a nozzle of said at least one array to be investigated;

identifying for said selected nozzle a number of compensating nozzles, each compensating nozzle being suitable to replace said selected nozzle for printing a dot;

printing a row, the row extending in a second direction being different from the first direction and comprising at least two dot groups, each dot group comprising at least one dot, wherein at least one dot group is printed by said selected nozzle and at least one other dot group is printed by a compensating nozzle selected from said number of compensating nozzles identified in said step of identifying; and visually comparing a position of a dot group in the row printed by said selected nozzle with a position of a dot group in the row printed by said compensating nozzle selected in said step of printing; and investigating a plurality of the at least two nozzles of said array by repeating said steps of selecting, identifying and printing, wherein the dot groups printed by the compensating nozzles are lying on a diagonal of a two-dimensional array of dot groups.

12. An inkjet printing apparatus, comprising:

a control unit; and a print head, the print head comprising at least one array of at least two nozzles, wherein each nozzle is configured to eject an ink drop for generating a dot on a receiving medium, wherein the control unit is configured to control the inkjet printing apparatus to perform a method for visually detecting misdirecting nozzles of the inkjet printer, the method being suitable for detecting nozzles misdirecting in a first direction, the method comprising printing a test pattern, and for each of the at least one array, printing the test pattern comprises the steps of:

selecting a nozzle of said at least one array to be investigated;

identifying for said selected nozzle a number of compensating nozzles, each compensating nozzle being suitable to replace said selected nozzle for printing a dot;

printing a row, the row extending in a second direction being different from the first direction and comprising at least two dot groups, each dot group comprising at least one dot, wherein at least one dot group is printed by said selected nozzle and at least one other dot group is printed by a compensating nozzle selected from said number of compensating nozzles identified in said step of identifying; and visually comparing a position of a dot group in the row printed by said selected nozzle with a position of a dot group in the row printed by said compensating nozzle selected in said step of printing; and investigating a plurality of the at least two nozzles of said array by repeating said steps of selecting, identifying and printing, wherein the dot groups printed by the compensating nozzles are lying on a diagonal of a two-dimensional array of dot groups.

13. The non-transitory computer readable medium according to claim 11, wherein the two-dimensional array of dot groups are formed by the dot groups arranged in the rows and the columns.

14. The inkjet printing apparatus according to claim 12, wherein the two-dimensional array of dot groups are formed by the dot groups arranged in the rows and the columns.

* * * * *